US005824219A

United States Patent [19]

Lai

[11] Patent Number: 5,824,219

[45] Date of Patent: Oct. 20, 1998

[54] WATER SPOUT SEAT OF WATER FILTRATION DEVICE

[76] Inventor: Cheng-Chen Lai, P.O. Box 453, Taichung, Taiwan

[21] Appl. No.: 985,569

[22] Filed: Dec. 5, 1997

[51] Int. Cl.[6] ..... B01D 35/157

[52] U.S. Cl. ..... 210/418; 210/459; 210/460; 210/463; 251/319; 251/320; 285/8; 137/562

[58] Field of Search ..... 210/418, 449, 210/459, 460, 463; 251/213, 231, 236, 238, 319, 320, 321, 354; 222/74, 189.11, 631, 320, 322, 381, 391; 137/317, 320, 279, 562, 561 R, 329.01, 329, 329.02; 285/8

[56] References Cited

U.S. PATENT DOCUMENTS

| | | | |
|---|---|---|---|
| 3,270,767 | 9/1966 | Hirsch . | |
| 3,464,435 | 9/1969 | Lamb et al. | 137/212 |
| 4,144,901 | 3/1979 | Stevenson | 137/317 |
| 4,741,363 | 5/1988 | Hu . | |
| 4,997,553 | 3/1991 | Clack | 210/257.2 |
| 4,998,673 | 3/1991 | Pilolla . | |
| 5,076,318 | 12/1991 | Fedora | 137/318 |
| 5,080,324 | 1/1992 | Chi . | |
| 5,087,018 | 2/1992 | Blase et al. . | |

*Primary Examiner*—W. L. Walker

[57] ABSTRACT

A water spout seat of the water filtration device is composed of a water discharge tube, a main body, a stop valve, and a trigger member, The main body is provided with a through hole, a water inlet, a chamber, a stop edge located between the through hole and the chamber, a stop lip located between the water inlet and the chamber, and an inclined connection hole located between the water inlet and a water outlet of the main body. The stop valve is provided with a tapered washer which is engaged securely with a tapered hole of a water admitting tube. The through hole, the chamber and the water inlet are located coaxially.

1 Claim, 7 Drawing Sheets

WATER SPOUT SEAT OF WATER FILTRATION DEVICE

FIELD OF THE INVENTION

The present invention relates generally to a water filtration device, and more particularly to a water spout seat of the water filtration device.

BACKGROUND OF THE INVENTION

As shown in FIGS. 1–3, a prior art water spout seat 10 of the water filtration device is provided with a water spout tube 11 which is provided therein with a rectifier 13 and is fastened with the water outlet 12 of a seat 10. The seat 10 is provided in the top thereof with a cross slot 14 having the water outlet 12 and a through hole 16. The seat 10 is further provided in the bottom thereof with a water inlet 15 in communication with the through hole 16 via a passage hole 17. Located between the water outlet 12 and the through hole 16 is a connection hole 18. A stop valve 19 is engaged with the through hole 16 and is fastened with a throttle valve 20. Located over the throttle valve 20 is a pull rod 21 which is retained by a trigger member 24. The water inlet 15 is engaged with a water admitting tube 22.

Such a prior art water spout seat 10 as described above is defective in design in that the connection hole 18 can not be easily finished, and that the water turbulence is brought about when water passes through the water inlet 15, the passage hole 17, the through hole 16, and the connection hole 18, and further that the stop valve 19 and the throttle valve 20 can not be easily disposed without a special hand tool, and still further that the trigger member 24 is prone to a mechanical friction with the cross slot 14, and still further that the washer 23 is vulnerable to wear, thereby causing the stop valve 19 and the throttle valve 20 to leak.

SUMMARY OF THE INVENTION

The primary objective of the present invention is therefore to provide a water filtration device with an improved water spout seat free from the structural deficiencies of the prior art water filtration device described above.

In keeping with the principle of the present invention, the foregoing objective of the present invention is attained by a water spout seat which is provided with a stop valve located between a through hole and a stop edge, and an inclined connection hole located between a water inlet and a water outlet. The water spout seat is relatively simple in construction and cost-effective.

The foregoing objective, features and functions of the present invention will be more readily understood upon a thoughtful deliberation of the following detailed description of an embodiment of the present invention with reference to the accompanying drawings.

DETAILED DESCRIPTION OF THE EMBODIMENT

Figure 1:
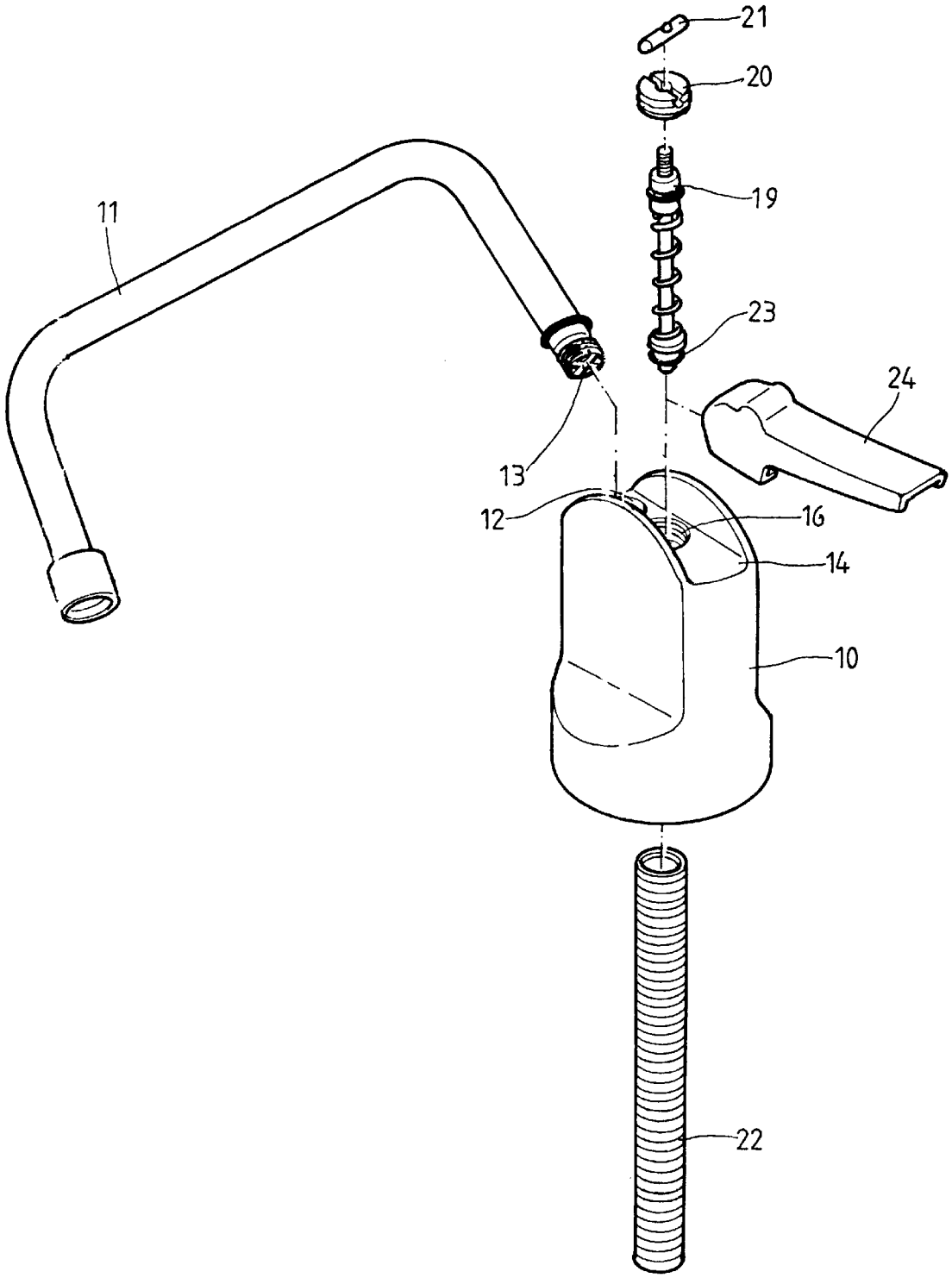
FIG.1 PRIOR ART
FIG. 1 shows an exploded view of a prior art water spout seat of the water filtration device.
Figure 2:
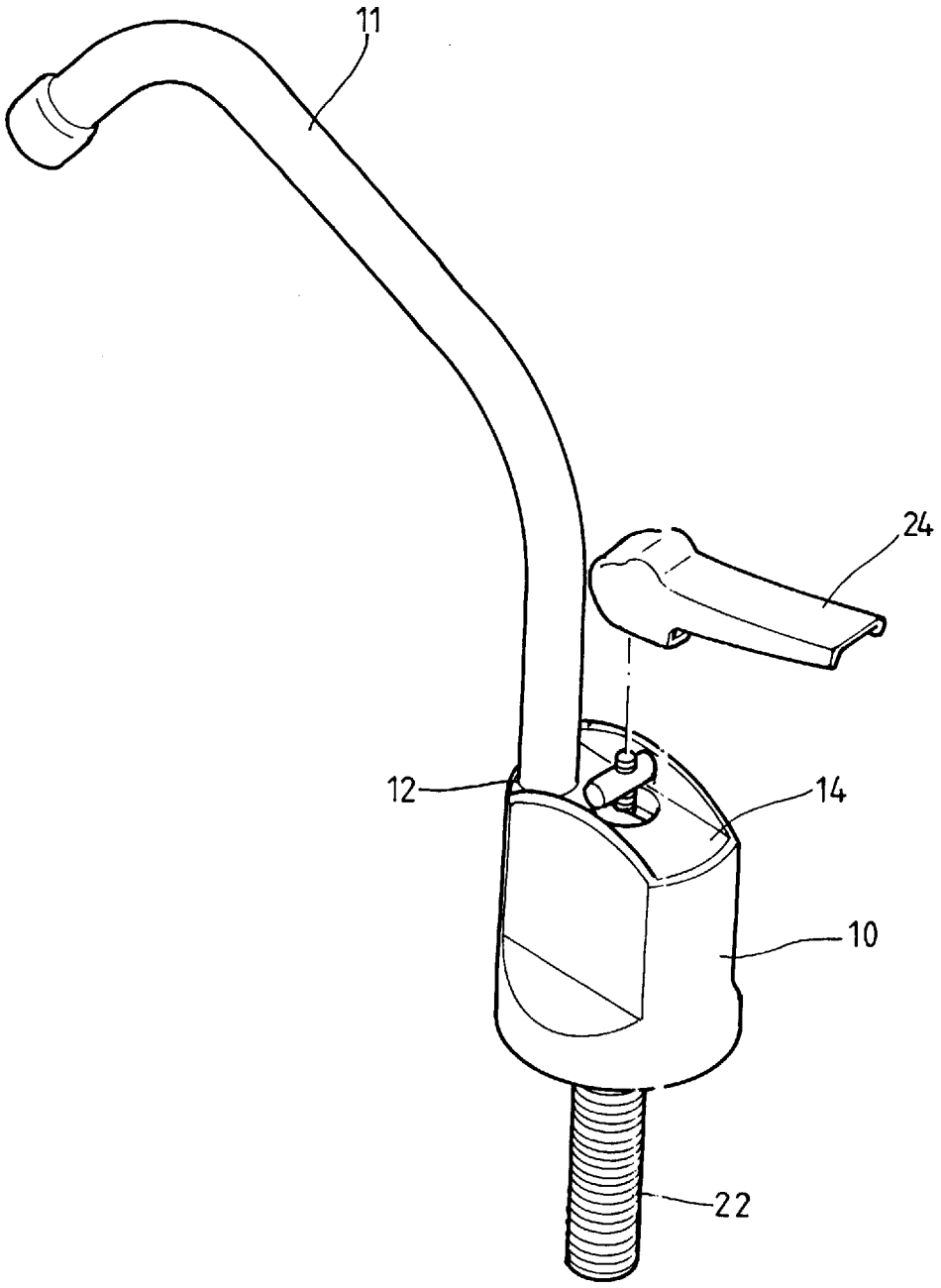
FIG.2 PRIOR ART
FIG. 2 shows a schematic view of the prior art water spout seat in combination.
Figure 3:
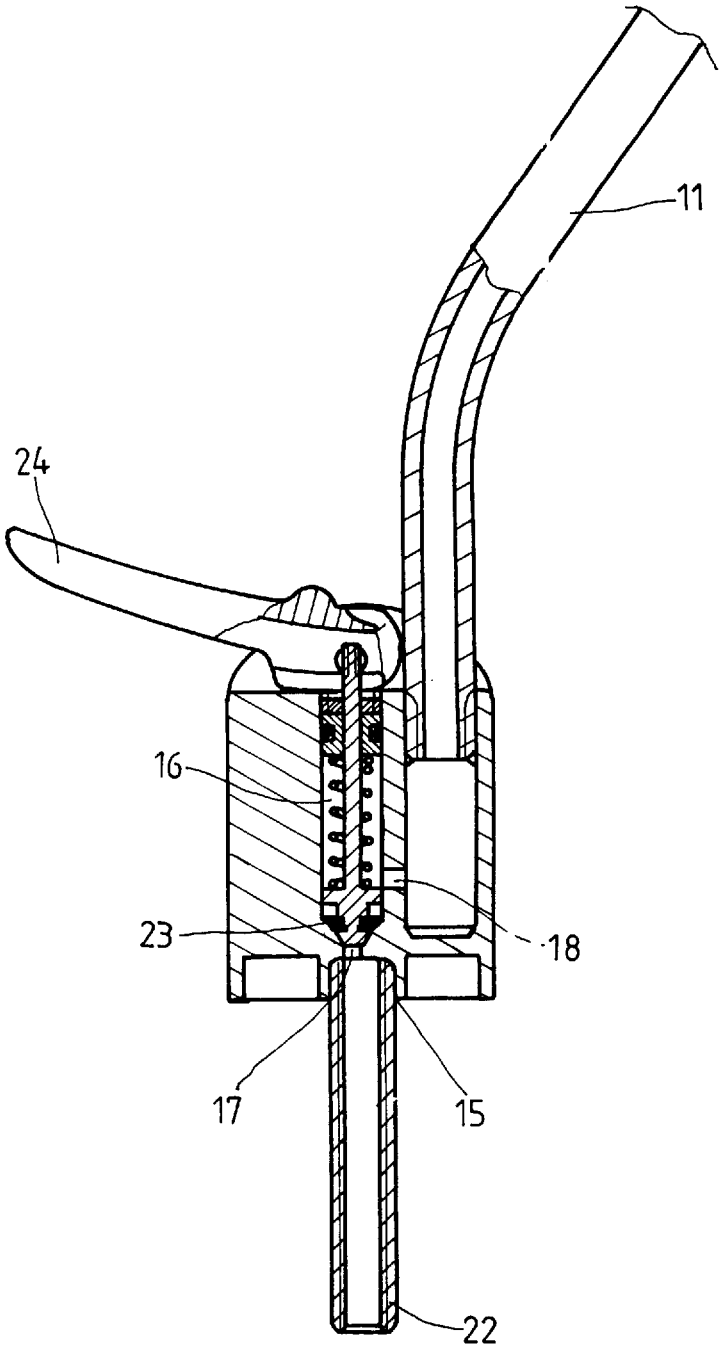
FIG.3 PRIOR ART
FIG. 3 shows a sectional view of the prior art water seat as shown in FIG. 2.
Figure 4:
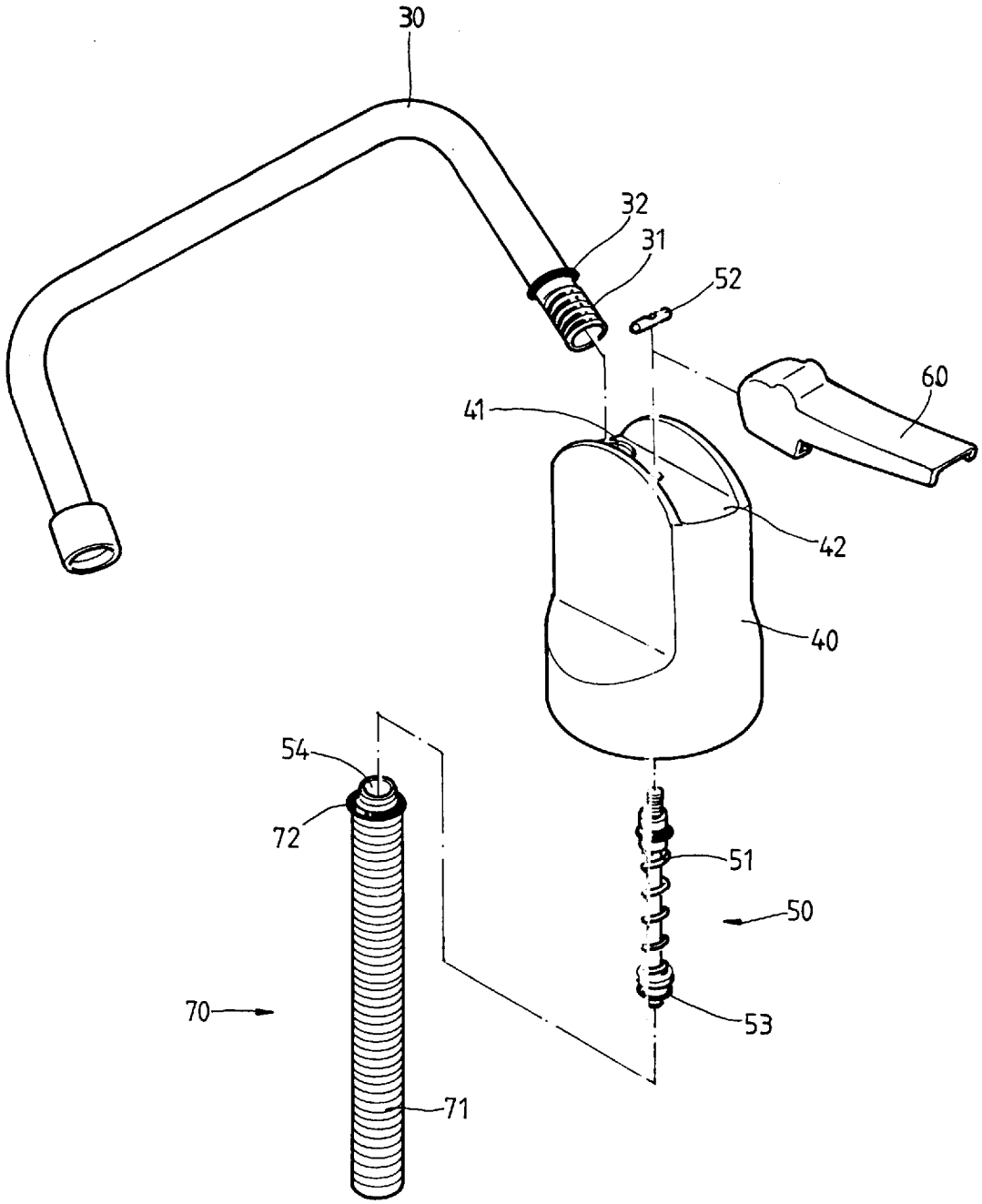
FIG. 4 shows an exploded view of a water spout seat of the present invention.
Figure 5:
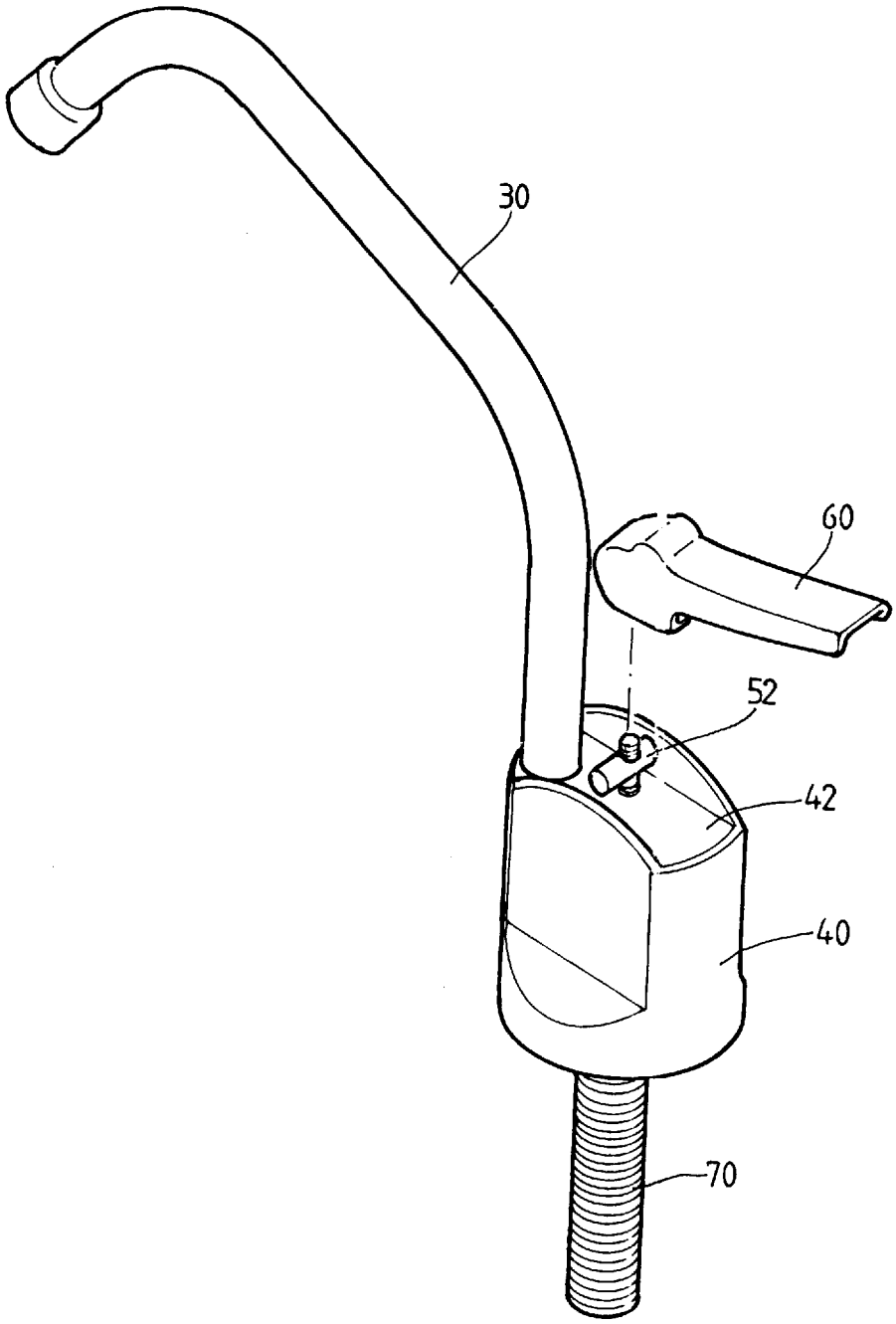
FIG. 5 shows a schematic view of the water spout seat of the present invention in combination.

As shown in FIGS. 4 and 5, a water spout seat embodied in the present invention is intended for use in a water filtration device and is composed of the component parts, which are described hereinafter.

A main body 40 is provided with a water outlet 41 engageable with a threaded portion 31 of a water discharge tube 30 in conjunction with a washer 32. The main body 40 is further provided at the top end thereof with a recess 42 in which the water outlet 41 is located. The main body 40 is still further provided at the bottom end thereof with a water inlet 44 and a chamber 45. The water inlet 44 is provided with a female threaded portion 43, whereas the chamber 45 is provided with a stop valve 50 which is provided with an elastic member 51, a T-shaped pull rod 52, and a washer 53. A trigger member 60 is engaged with the pull rod 52. A water admitting tube 70 is provided at one end thereof with a male threaded portion 71, which is engaged with the female threaded portion 43 of the main body 40 in conjunction with a washer 72.

Figure 6:
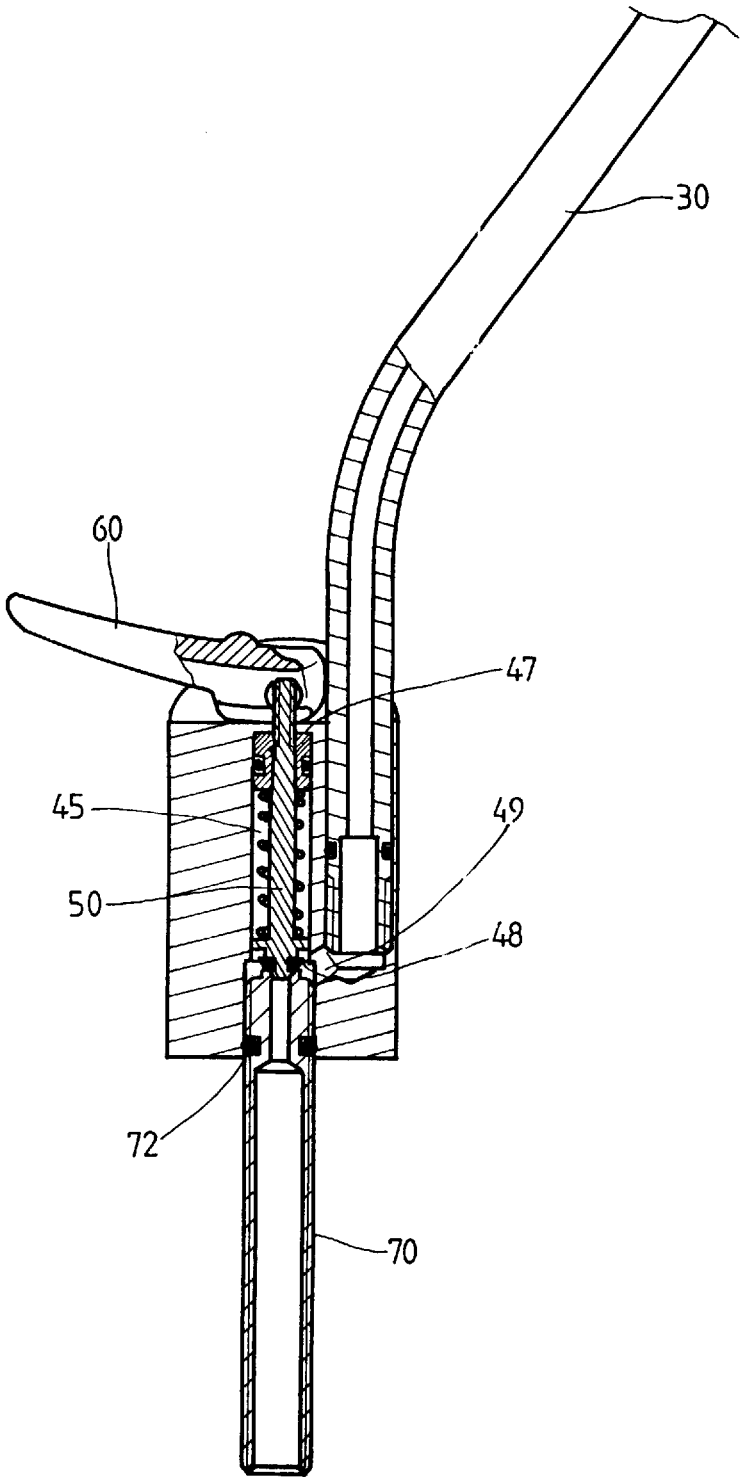
FIG. 6 shows a sectional view of the water spout seat as shown in FIG. 5.
Figure 7:
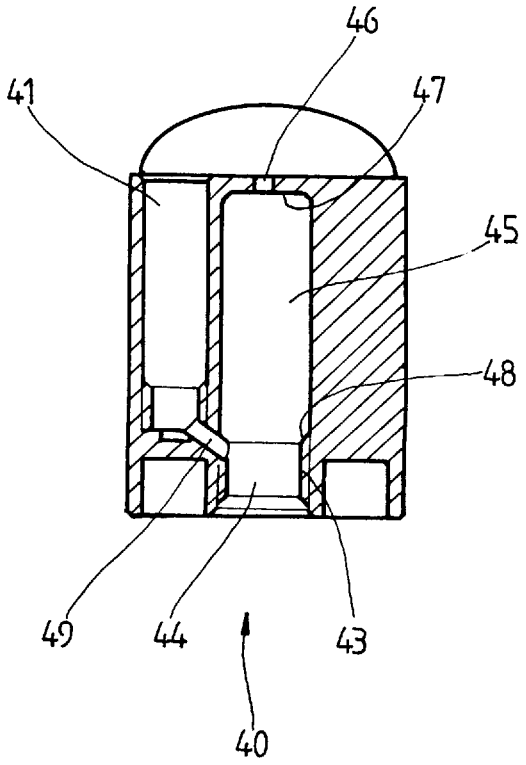
FIG. 7 shows a sectional view of a main body of the water spout seat of the present invention.

As shown in FIGS. 6 and 7, the main body 40 is characterized in design in that it has a stop edge 47 located between a through hole 46 and the chamber 45, a stop lip 48 located between the bottom of the water inlet 44 and the chamber 45, and an inclined connection hole 44 and the chamber 45, and an inclined connection hole 49 located between the water outlet 41 and the stop lip 48.

The washer 53 of the stop valve 50 is tapered and engaged securely with a tapered hole 54 of the water admitting tube 70 to provide a leakproof effect. The through hole 46, the chamber 45 and the water inlet 44 are located coaxially.

The water spout seat of the embodiment of the present invention has several advantages, which are described explicitly hereinafter.

The stop valve 50 and the water admitting tube 70 are engaged in a leakproof manner by means of the tapered washer 53 and the tapered hole 54 which is securely engaged with the tapered washer 53.

The stop valve 50 can be easily installed by fitting the stop valve 50 directly into the through hole 46 before engaging with the T-shaped pull rod 52.

The water outlet 41 and the water inlet 44 are provided therebetween with the inclined connection hole 49. The water inlet 44 is inclined for easy operation in view of the lack of the right angle to be overcome.

The water is allowed to flow smoothly into the water discharge tube 30 without the water turbulence, thanks to the inclined connection hole 49 which is arranged in an inclined manner rather than in a horizontal manner. As a result, the water discharge tube 30 is devoid of a rectifier.

The embodiment of the present invention described above is to be regarded in all respects as being merely illustrative and not restrictive. Accordingly, the present invention may be embodied in other specific forms without deviating from the spirit thereof. The present invention is thereofre to be limited only by the scope of the following appended claim.

What is claimed is:

1. A water spout seat of a water filtration device, said water spout seat comprising:

a main body provided at one end thereof with a water outlet engageable with a water discharge tube of the water filtration device, and at another end thereof with a water inlet having a female threaded portion, said main body further provided with a chamber extending along the direction of a longitudinal axis of said main body such that said chamber is located between said water outlet and said water inlet;

a stop valve located in said chamber of said main body and provided with an elastic member, a pull rod, and a tapered washer;

a trigger member engaged with said pull rod of said stop valve; and a water admitting tube provided with a male threaded portion engaged with said female threaded portion of said water inlet of said main body, said water admitting tube further provided with a tapered hole engaged with said tapered washer of said stop valve;

wherein said main body is provided with a recess in communication with a through hole located in said chamber, and a stop edge located between said through hole and said chamber;

wherein said main body is further provided with a stop lip located between said water inlet and said chamber, and an inclined connection hole located between said water outlet and said stop lip;

wherein said through hole, said chamber and said water inlet are located coaxially.

* * * * *